US006741156B2

(12) United States Patent
Burkhardt et al.

(10) Patent No.: US 6,741,156 B2
(45) Date of Patent: May 25, 2004

(54) ROD-CORE TRANSFORMER AND A LAMP CAP HAVING A ROD-CORE TRANSFORMER

(75) Inventors: Matthias Burkhardt, Munich (DE); Herbert Maurizio Cardarelli, Munich (DE); Bernhard Roellgen, Munich (DE)

(73) Assignee: Patent-Treuhand-Gelleschaft fur elektrische Gluhlampen mbH, Munich (DE)

( * ) Notice: Subject to any disclaimer, the term of this patent is extended or adjusted under 35 U.S.C. 154(b) by 0 days.

(21) Appl. No.: 10/360,795

(22) Filed: Feb. 10, 2003

(65) Prior Publication Data

US 2003/0151375 A1 Aug. 14, 2003

(30) Foreign Application Priority Data

Feb. 14, 2002 (DE) ..... 102 06 180

(51) Int. Cl.[7] ..... H01F 27/28

(52) U.S. Cl. ..... 336/229; 336/225; 336/180; 315/281; 315/282

(58) Field of Search ..... 336/229, 225, 336/180, 219, 179, 221, 222; 315/281, 282, 56–57, 209 PZ, 209 M, 276, 274, 209 R, 224

(56) References Cited

U.S. PATENT DOCUMENTS

| | | | | |
|---|---|---|---|---|
| 5,072,158 A | * | 12/1991 | Schuda | 315/276 |
| 6,028,401 A | * | 2/2000 | Slegers et al. | 315/290 |
| 6,111,366 A | * | 8/2000 | Olsson et al. | 315/276 |
| 2001/0019297 A1 | * | 9/2001 | Niemetz et al. | 336/92 |

FOREIGN PATENT DOCUMENTS

WO 00/59269 10/2000

* cited by examiner

*Primary Examiner*—Tuyet T. Vo

(57) ABSTRACT

A rod-core transformer for use as a starting transformer in the cap of a high-pressure discharge lamp for a motor vehicle headlight. The rod-core transformer has at least two cores (2, 3) which are in the form of rods and are arranged alongside one another, and on each of which a multilayer secondary winding (4, 5) is wound, with the respective layers (4*a*, 4*b*, 4*c*, 4*d*) and (5*a*, 5*b*, 5*c*, 5*d*) being connected in parallel and being arranged one above the other without any offset. Furthermore the secondary windings (4, 5) are electrically conductively connected to one another, with their total resistance being at most 2Ω. The transformer is particularly highly suitable for use as a starting transformer for high-pressure discharge lamps with a low operating voltage, for example halogen metal-vapor high-pressure discharge lamps which do not contain mercury.

20 Claims, 5 Drawing Sheets

ROD-CORE TRANSFORMER AND A LAMP CAP HAVING A ROD-CORE TRANSFORMER

Figure 1:
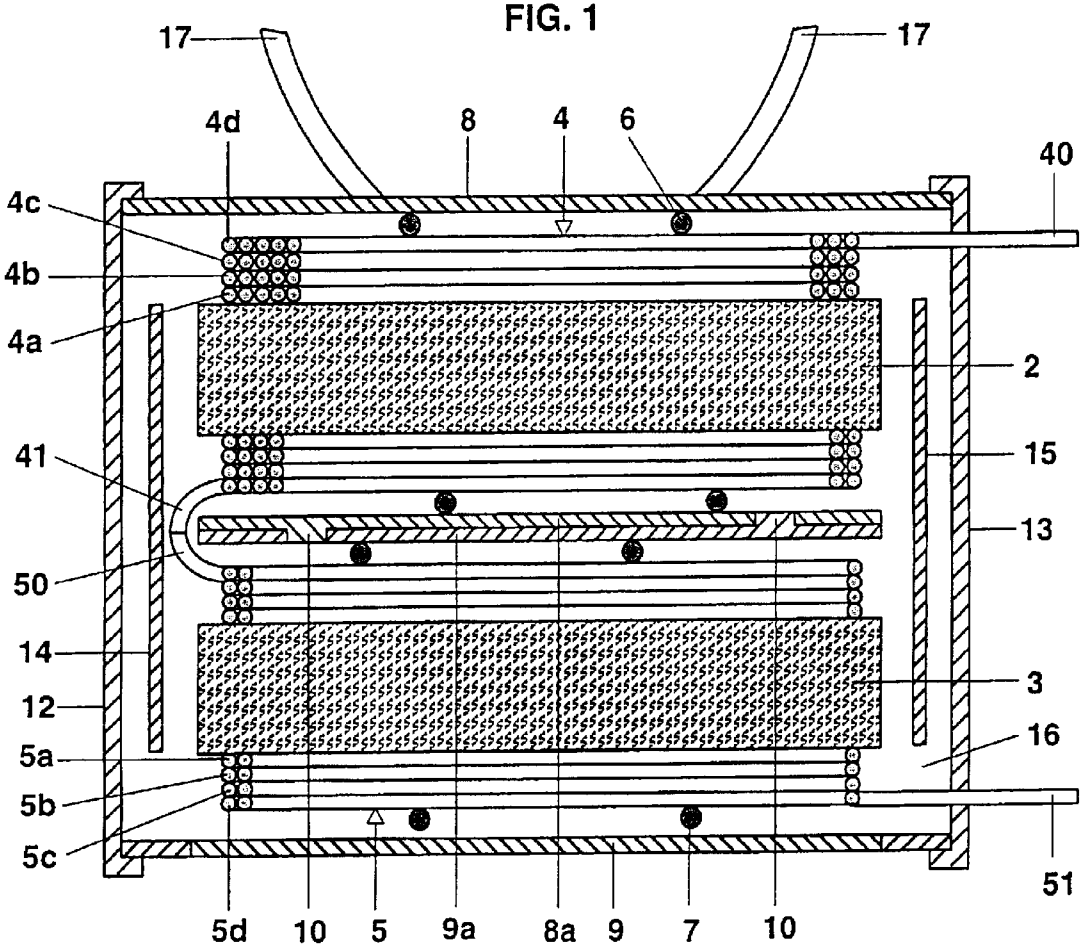

The invention relates to a rod-core transformer according to Patent Claim 1 and to a discharge lamp cap having such a rod-core transformer, as well as to a high-pressure discharge lamp which does not contain any mercury for a motor vehicle headlight.

I. PRIOR ART

The International Patent Application PCT/EP00/02608 with the Publication Number WO 00/59269 discloses a gas-discharge lamp cap having a starting device which has a torroidal-core transformer arranged in the cap. The torroidal-core transformer is used for producing the starting voltage for the gas-discharge lamp.

II. DESCRIPTION OF THE INVENTION

The object of the invention is to provide a transformer which is suitable for use as a starting transformer in a lamp cap and whose resistive losses in the windings are as low as possible. In particular, the transformer is intended to be capable of use as a starting transformer for a halogen metal-vapour high-pressure discharge lamp which does not contain mercury and whose operating voltage is approximately 50% lower than that of a corresponding halogen metal-vapour high-pressure discharge lamp which does contain mercury.

According to the invention, this object is achieved by the features of Patent Claim 1. Particularly advantageous embodiments of the invention are described in the dependent patent claims.

The transformer according to the invention is in the form of a rod-core transformer and has at least one primary winding,

- at least two cores which are in the form of rods, are arranged with their longitudinal axes offset parallel alongside one another, and are composed of an electrically insulating material,
- a first secondary winding whose turns are arranged on the first core, with the first secondary winding having a number of parallel-connected layers of turns, and each layer of turns being arranged without any offset above the next lower layer, so that each turn in any given layer is arranged exactly above the corresponding turn of the layer located immediately underneath it of the first secondary winding,
- at least one further secondary winding whose turns are arranged on at least one further core which is in the form of a rod, with the second secondary winding having a number of parallel-connected layers of turns, and each layer of turns being arranged without any offset above the next lower layer, so that each turn in any given layer is arranged exactly above the corresponding turn of the layer located immediately underneath it of the at least one further secondary winding, with
  - the secondary windings being electrically conductively connected to one another, and the total resistance of the secondary windings being less than or equal to 2Ω.

The embodiment of the transformer as a rod-core transformer allows this transformer to be inserted more easily into the lamp cap than, for example, a torroidal-core transformer, by means of an automatic placement machine.

In order to minimize the power losses in the windings of the rod-core transformer and, furthermore, also to make it possible to generate a sufficiently high voltage for starting the discharge lamp, the rod-core transformer according to the invention has a number of secondary windings which are electrically conductively connected to one another and are fitted on at least two cores which are in the form of rods and are arranged with their longitudinal axes offset parallel alongside one another, with the total resistance of the secondary windings being less than or equal to 2Ω. The secondary windings each have a number of layers of turns which are wound one on top of the other and are connected in parallel, in order to ensure that the current flow on the secondary side is still sufficiently high even if the transformation ratio is high. In order to prevent electrical flashovers from occurring between the turns of different layers of a secondary winding, the layers of a secondary winding are arranged exactly one above the other, without any offset. There is therefore no voltage difference between the corresponding turns of the layers, which are arranged one above the other, of the secondary winding. Furthermore, the secondary windings wound in this way have only a small capacitance, so that the rod-core transformer according to the invention is also suitable for operation in the Megahertz band.

The secondary windings that are arranged on different cores which are in the form of rods are preferably connected in series. Their induction voltages are thus added to one another, and a higher starting voltage for the discharge lamp is available on the secondary side of the rod-core transformer. If the secondary windings are not all required in order to produce an induction voltage that is as high as possible, a number of secondary windings or even all the secondary windings can be connected in parallel, in order in this way to reduce the total resistance of the secondary windings.

The cores, which are in the form of rods, of the transformer according to the invention are advantageously in the form of ferrites and, in particular, as nickel-zinc sintered ferrites, owing to their high relative permeability. Ferrites such as these are composed of a sintered nickel-zinc mixed oxide, which has a comparatively high electrical resistivity of approximately $10^5$ Ωm. The ferrites may thus, de facto, be regarded as electrical insulators. They ensure that the rod-core transformer has a high breakdown resistance, and thus allow the production of very high induction voltages.

The rod-core transformer according to the invention advantageously has two, and only two, cores which are in the form of rods and each have a secondary winding arranged on them, with each of these secondary windings having 50 to 200 turns. A rod-core transformer such as this has a physically compact design and has a sufficient number of turns on the secondary side to ensure a sufficiently high transformation ratio for using it as a starting transformer. The wire diameter of the secondary windings is advantageously greater than or equal to 0.1 mm, and is preferably even greater than 0.2 mm, in order to keep the total resistance of the secondary windings as low as possible. It has been found that a rod-core transformer having only two cores which are in the form of rods and having two secondary windings which each have 50 to 200 turns and whose wire diameter is greater than 0.1 mm and preferably even greater than 0.2 mm makes it possible to produce a starting transformer for producing the starting voltage for a high-pressure discharge lamp, which starting transformer has a small physical extent, so that it can be inserted into the cap of a high-pressure discharge lamp for a motor vehicle headlight, and its secondary side has a sufficiently low internal resistance in order to allow the rod-core transformer to be used to operate even high-pressure discharge lamps with a comparatively low operating voltage, such as halogen metal-vapour high-pressure discharge lamps which do not contain mercury. The secondary of the rod-core transformer has a resistance which is sufficiently low that only minor losses occur here, even when the lamp current flows through the secondary windings—as is normal when used in pulsed starting devices—after successfully starting the gas discharge in the lamp.

The at least one primary winding of the rod-core transformer is advantageously arranged such that the magnetic flux in two cores which are in the form of rods and are arranged alongside one another in each case runs in opposite directions. This can be achieved in a simple manner by arranging one primary winding on each core, which is in the form of a rod and is preferably composed of a ferrite, with the primary windings being connected in parallel. These measures reduce the stray field from the transformer. In addition, ferrite platelets are advantageously arranged in the ends of the ferrite cores (which are in the form of rods) and each interact with two adjacent ferrite cores (which are in the form of rods) in order to constrain the stray field of the transformer. This further reduces the losses in the rod-core transformer. The distance between the ferrite platelets and the ends of the ferrite cores, which are in the form of rods, is advantageously variable or adjustable, in order to make it possible to set the inductance of the transformer according to the invention to the desired value.

The primary winding or the primary windings of the rod-core transformer according to the invention advantageously has or have only one to three turns, in order to achieve a transformation ratio which is as high as possible and in this way to allow a correspondingly high induction voltage.

The cores, which are in the form of rods, and the secondary windings, which are arranged on them, of the rod-core transformer according to the invention are advantageously each accommodated in a separate housing, and the housings can be connected to one another by means of a plug connection. In consequence, the individual cores, which are in the form of rods, can be arranged alongside one another with well-defined spacing, and can be protected from external influences, in a simple manner. These housings are preferably composed of an electrically insulating material, such as plastic, in order to ensure that the transformer can withstand sufficiently high voltages. For the same reason, the cavities in the housing are advantageously filled with an electrically insulating encapsulation compound. The encapsulation compound preferably contains a ferrite powder which is homogeneously mixed with it, in order to improve the inductance of the rod-core transformer. The ferrite powder in the encapsulation compound may be used in addition to the ferrite platelets mentioned above, or instead of these ferrite platelets. However, it is also possible to dispense with both the ferrite platelets and the ferrite powder in the encapsulation compound.

III. DESCRIPTION OF THE PREFERRED EXEMPLARY EMBODIMENT

Figure 2:
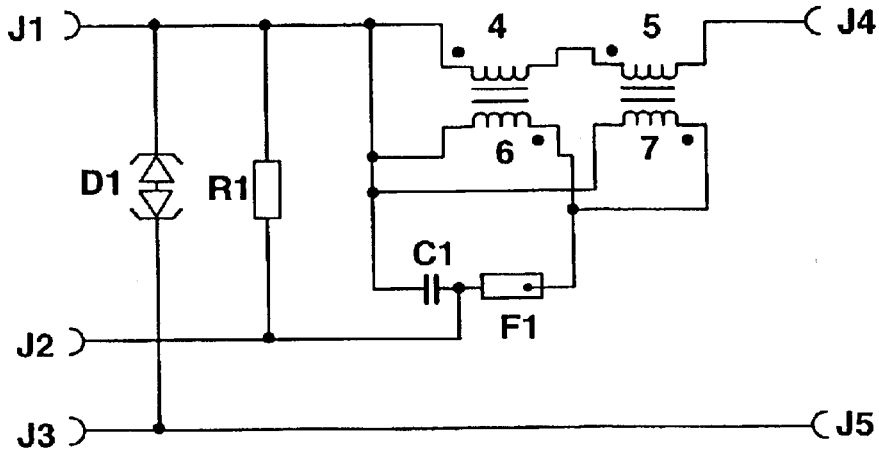
Figure 3:
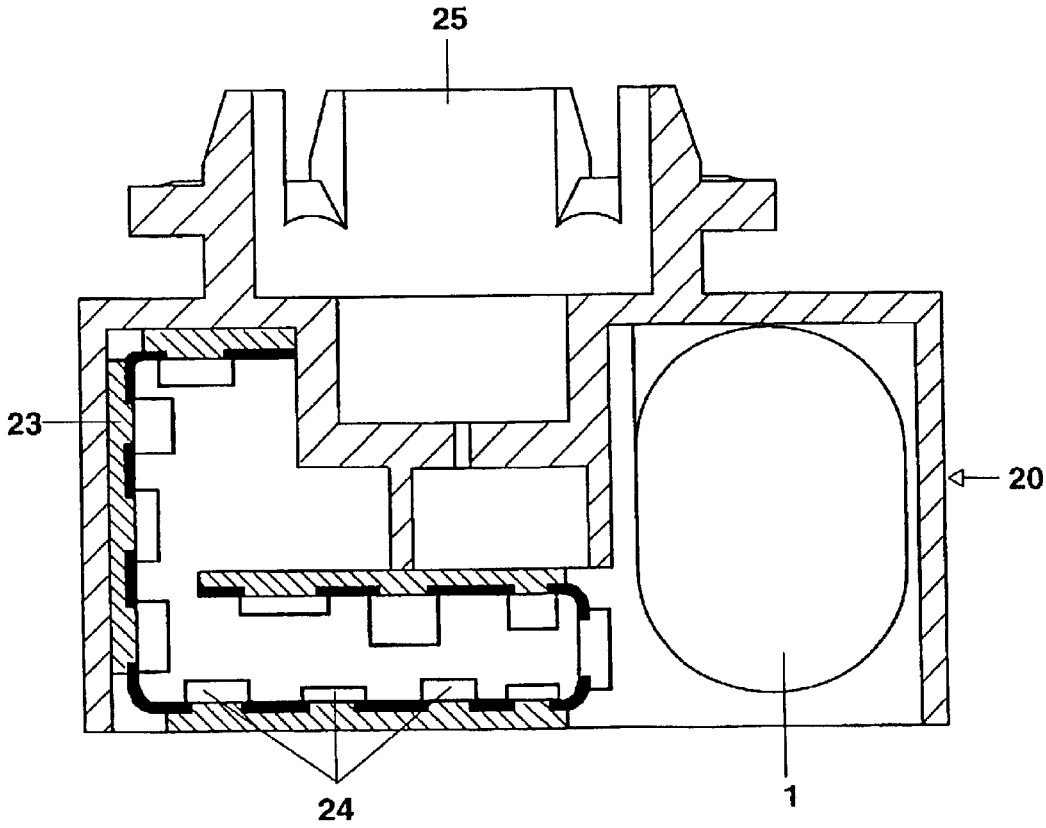
Figure 4:
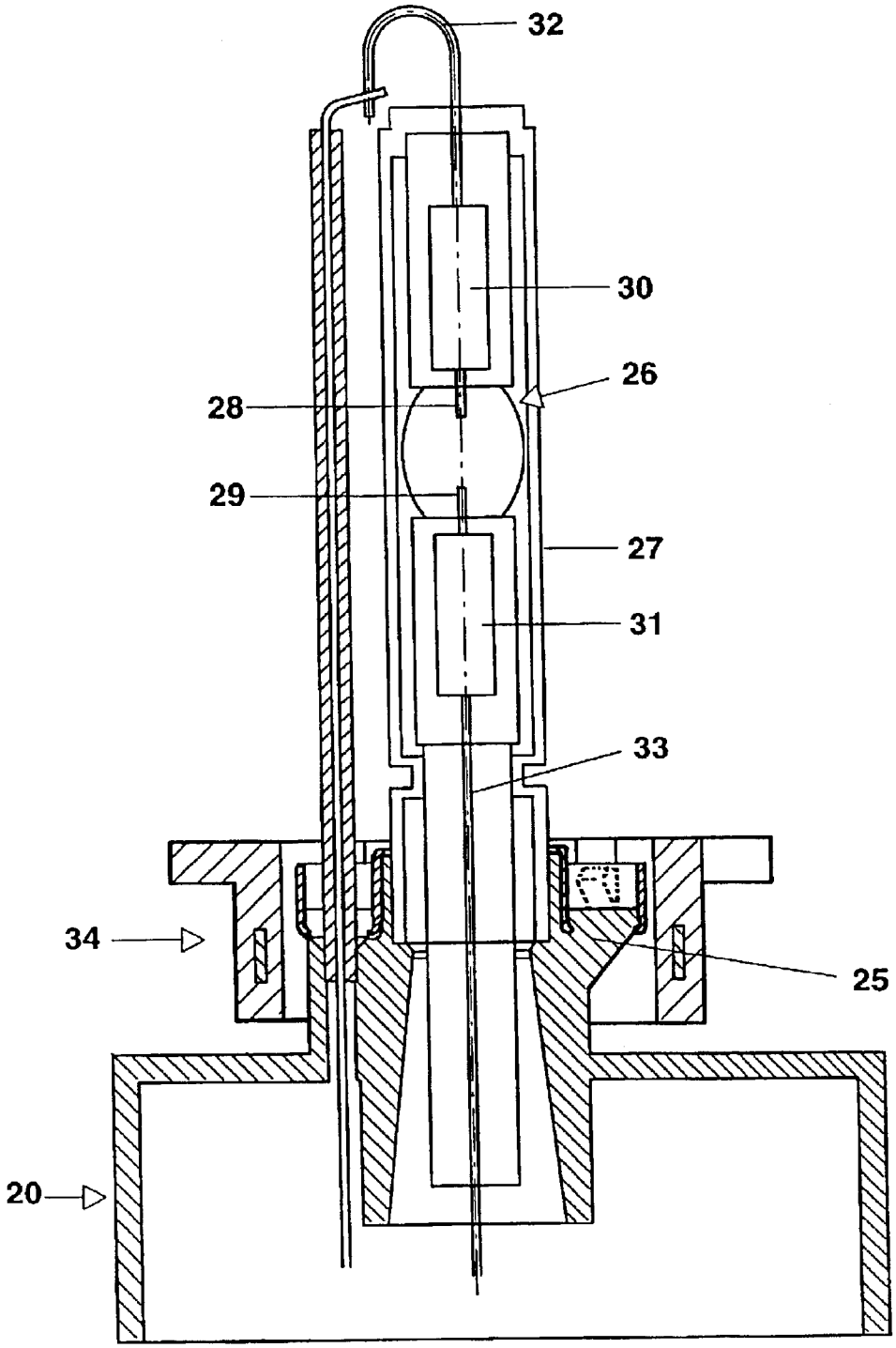
Figure 5:
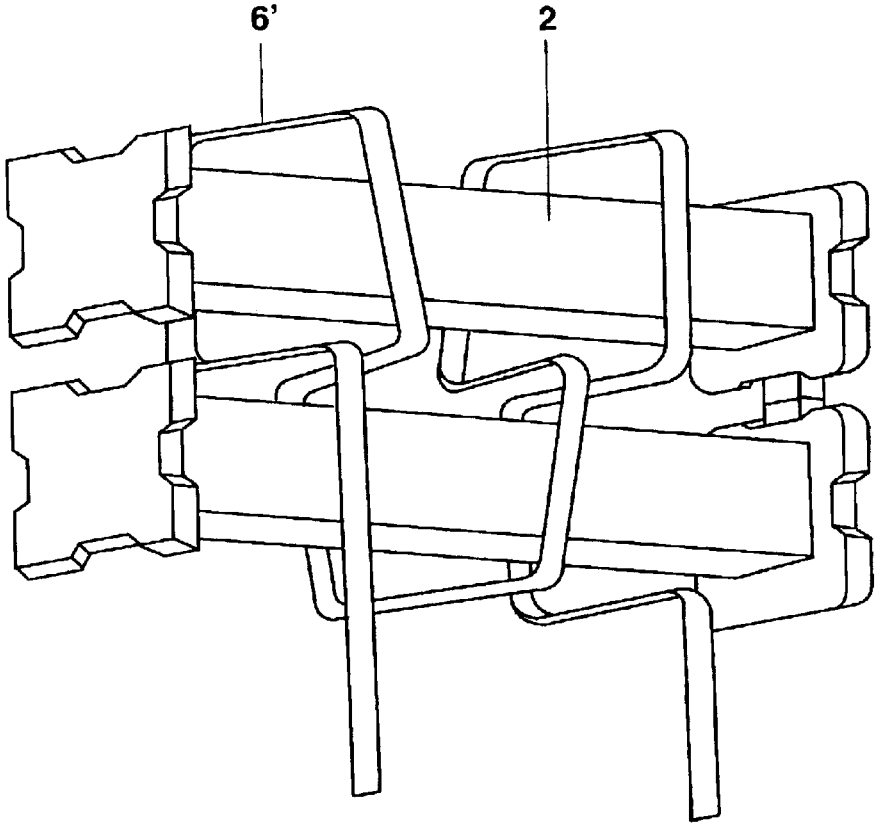

The invention will be explained in more detail in the following text with reference to a preferred exemplary embodiment. In the figures:

FIG. 1 shows a cross section through the rod-core transformer according to the preferred exemplary embodiment of the invention, in the form of a schematic illustration, FIG. 2 shows a sketch of a circuit of a starting device for a high-pressure discharge lamp, with the rod-core transformer shown in FIG. 1 as a starting transformer, FIG. 3 shows a cross section through a part of the cap of a high-pressure discharge lamp with the rod-core transformer as shown in FIG. 1 arranged in it, FIG. 4 shows a side view of a high-pressure discharge lamp with the cap part shown in FIG. 3, and FIG. 5 shows a plan view of the rod-core transformer according to a further preferred exemplary embodiment of the invention, in the form of a schematic illustration.

The preferred exemplary embodiment of the invention illustrated in FIG. 1 comprises a rod-core transformer 1 having two ferrite cores 2, 3 which are in the form of rods and are arranged with their longitudinal axes offset parallel alongside one another. The ferrite cores 2, 3 are each composed of an essentially cuboid nickel-zinc sintered ferrite with an essentially square cross section of 25 $mm^2$. The length of the ferrite cores is 31 mm. A four-layer secondary winding 4, 5 is arranged on each ferrite core 2, 3. The two secondary windings 4, 5 are designed to be completely identical and are connected in series so that their induction voltages are added to one another. Each of the four layers 4*a*, 4*b*, 4*c*, 4*d* and 5*a*, 5*b*, 5*c*, 5*d* of a respective secondary winding 4 or 5 is equipped with 110 turns. The four layers 4*a*, 4*b*, 4*c*, 4*d* and 5*a*, 5*b*, 5*c*, 5*d* of the respective secondary windings 4, 5 are illustrated schematically and only partially sectioned in FIG. 1. The turns of two respectively adjacent layers are arranged exactly one above the other. This means that, for example, the first turn of the second layer of the secondary winding 4 or 5 is arranged exactly above the first turn of the first layer of the respective secondary winding 4 or 5. This situation is illustrated schematically in FIG. 1. A corresponding situation applies to all the other turns in the first and second layers of the respective secondary windings 4 and 5 and to all the adjacent layers in the respective secondary windings 4 and 5. The four layers 4*a*, 4*b*, 4*c*, 4*d* of the secondary winding 4 are connected in parallel, so that the current components induced in the four layers 4*a*, 4*b*, 4*c*, 4*d* add up to form the total current. The same also applies to the four layers 5*a*, 5*b*, 5*c*, 5*d* of the secondary winding 5. The secondary windings 4, 5 each consist of a copper wire with a diameter of 0.24 mm. The copper wire is provided with a varnish layer in order to provide its electrical insulation. The two secondary windings 4, 5 are connected in series and have a total resistance of 0.47Ω.

Furthermore, a primary winding 6, 7 is arranged on each ferrite core 2, 3, and each primary winding 6, 7 has two turns. The primary windings 6, 7 are wound on the respective secondary winding 4 or 5 of the corresponding respective ferrite core 2 or 3. The primary windings 6, 7 are in the form of copper strips. The two ferrite cores 2, 3 and the secondary windings 4, 5 as well as the primary windings 6, 7 which are fitted to them are each accommodated in a separate, essentially cuboid housing 8, 9, composed of plastic. The end faces of the housings 8, 9 that are arranged at the ends of the ferrite cores 2, 3 are open. The essentially cuboid housings 8, 9 have a respective wall 8*a*, 9*a* with a reduced extent in the longitudinal direction. These walls 8*a*, 9*a* touch one another and are connected to one another by means of a plug connection 10. The open end faces of the essentially cuboid housings 8, 9 are closed by means of a respective plastic cover 12, 13. Each plastic cover 12 or 13 is designed such that it covers not only the open end face of the housing 8 which is arranged at the same end of the ferrite cores 2, 3 but also that of the housing 9.

Ferrite platelets 14, 15 are arranged at the ends of the respective ferrite cores 2, 3, in order to constrain the stray field of the transformer. The ferrite platelets 14, 15 are arranged at a predetermined distance from the ends of the ferrite cores 2, 3, in order to set the inductance of the transformer to the desired value. The cavities between the walls of the housings 8, 9 and the plastic covers 12, 13 as well as the ferrite cores 2, 3 and the ferrite platelets 14, 15 are filled with an electrically insulating encapsulation compound 16. The secondary windings 4, 5 and the primary windings 6, 7 are wound in senses such that the magnetic flux runs in opposite directions in the ferrite cores 2, 3, which are arranged parallel. The winding start 40 of the first secondary winding 4 and the winding end 51 of the second secondary winding 5 are passed out of the respective housing 8 or 9. The winding end 41 of the first secondary winding 4 is connected to the winding start 50 of the second secondary winding 5. The two connections 17 of the parallel-connected primary windings 2, 3 are likewise passed out of the respective housing 8 or 9.

FIG. 2 shows a sketch of the circuit of a starting device for a high-pressure discharge lamp with the rod-core transformer 1 as described above. This starting device is a pulsed starting device, which essentially comprises a starting capacitor C1, a spark gap F1, a high-value resistor R1, a bidirectional threshold switch D1 and the windings 4, 5, 6, 7 of the rod-core transformer 1. The starting voltage for the high-pressure discharge lamp is produced at the output terminals J4, J5 of the starting device. The input terminal J3 is at earth potential. A DC voltage of −400 V is provided at the input terminal J1, and a DC voltage of +600 V is provided at the input terminal J2. The construction of the pulsed starting device illustrated schematically in FIG. 2 is prior art and will therefore not be explained in any more detail here. The two primary windings 6, 7 are connected in parallel and are arranged in series with the spark gap F1, so that the parallel circuit formed by the two primary windings 6, 7 is connected via the spark gap F1 to the input terminals J1, J2. In order to start the high-pressure discharge lamp which is connected to the terminals J4, J5, the starting capacitor C1 is charged to the breakdown voltage of the spark gap F1. The capacitor C1 is then suddenly discharged via the spark gap F1 and the primary windings 6, 7. This generates a high induction voltage in the secondary windings 4, 5. Since the secondary windings 4, 5 are connected in series, the sum of the induction voltages from the two secondary windings 4, 5 and of the voltage of the input terminal J1 is available at the output terminal J4. In FIG. 2, the winding start of the individual windings 4, 5, 6, 7 is denoted by a dot. Voltages up to 40 kV for starting the high-pressure discharge lamp are produced at the output terminals J4, J5 by the starting device.

The starting device explained above is accommodated in the cap 20 of a high-pressure discharge lamp. FIG. 3 shows a cross section through the upper part of the cap 20 of a high-pressure discharge lamp, which is intended for use in a motor vehicle headlight. The rod-core transformer 1 is arranged in a separate chamber 21 in the cap 20. A meandering mounting plate 23 is arranged in a second chamber 22 in the cap 20 and is fitted with the other components F1, R1, D1, C1 of the starting device and with components 24 of the operating equipment for the high-pressure discharge lamp. On the top face, the cap 20 has a holder 25 for the discharge vessel of the high-pressure discharge lamp. The lower face of the cap 20 is closed by a cover (not shown) and is equipped with the electrical connections (not shown) of the lamp.

FIG. 4 shows a partially sectioned side view of the upper part of the cap 20 and of the lamp vessels 26, 27, which are mounted in the holder 25, of the high-pressure discharge lamp. This lamp is a halogen metal-vapour high-pressure discharge lamp which does not contain mercury and has an electrical power consumption of approximately 35 W. This lamp has a discharge vessel 26 which is sealed at both ends, is composed of quartz glass and is surrounded by an outer bulb 27 of glass which is attached to it. The outer bulb 27 and the discharge vessel 26 are fixed in a known manner in the holder 25 of the cap 20. Two electrodes 28, 29 are arranged within the discharge vessel 26 in order to produce a gas discharge. Xenon and metal halogenide, which are in the form of vapour in the discharge, are used as the discharge medium. The electrodes 28, 29 are connected via a respective molybdenum sheet vacuum-tight seal 30, 31 and a respective power supply 32, 33 to the respective output terminals J4 and J5 of the starting device, and to the components 24 of the operating equipment. In order to install the halogen metal-vapour high-pressure discharge lamp in a motor vehicle headlight, the cap 20 is equipped with an adjusting ring 34, which is welded to the holder 25 of the cap 20.

The invention is not restricted to the exemplary embodiment explained in relatively great detail above. For example, the ferrite platelets 12, 13 may also be arranged in the covers 14, 15 of the housing. However, it is also possible to dispense with the ferrite platelets and, instead of them, to homogeneously mix a ferrite powder into the encapsulation compound 16, or even to dispense with the ferrite platelets and the mixing of the ferrite powder into the encapsulation compound. The housings 8, 9 may, of course, also be designed in different ways. In particular, it is also possible to dispense with the plastic covers on the end faces.

Furthermore, the rod-core transformer according to the invention may also have more than two ferrite cores, which are in the form of rods, and secondary windings. In particular, the rod-core transformer could have four identical ferrite cores, which are in the form of rods, each having a secondary winding, with the secondary windings being arranged in two rows one above the other and alongside one another. These four secondary windings could be connected such that two secondary windings form a first pair of series-connected secondary windings, and the third and fourth secondary windings form a second pair of series-connected secondary windings, with the two pairs of secondary windings being connected in parallel, in order to reduce the resistance of the secondary of the transformer.

Furthermore, the rod-core transformer according to the invention may also have cores, which are in the form of rods, composed of a different electrically insulating material, for example of plastic, instead of the ferrite cores (2, 3).

FIG. 5 shows a further preferred exemplary embodiment of the rod-core transformer according to the invention, illustrated schematically. This exemplary embodiment differs from the first exemplary embodiment which has been explained above and is shown in FIG. 1 only in the configuration of the primary winding 6'. All the other details of the two exemplary embodiments correspond to one another. For this reason, the same reference symbols have also been chosen for identical parts. In order to improve the clarity, the two secondary windings 4, 5 are not shown in FIG. 5. In this exemplary embodiment as well, the secondary windings 4, 5 are wound onto the rod cores 2 and 3, respectively, in the same way as in the first exemplary embodiment explained above. In contrast to the exemplary embodiment which is shown in FIG. 1, the exemplary embodiment which is shown in FIG. 5 has only one primary winding 6', which is arranged above the secondary windings that are not shown in FIG. 5. The primary winding 6' consists of a copper strip which is wound alternately around the first rod core 2 and around the second rod core 3, so that two turns of the primary winding 6' are in each case arranged on each rod core 2, 3, with the winding sense of the turns of the primary winding 6' which are arranged on the first rod core 2 being the opposite of the winding sense of the turns of the primary winding 6' which are arranged on the second rod core 3, as is illustrated schematically in FIG. 5. A magnetic flux in the opposite direction is thus generated in the rod cores 2 and 3.

What is claimed is:

1. A discharge lamp cap having a rod-core transformer (1) arranged in the discharge lamp cap (20) and used to produce the starting voltage for the discharge lamp, the rod-core transformer (1) comprising:

at least one primary winding (6, 7; 6'), at least two cores (2, 3) which are in the form of rods, are arranged with their longitudinal axes offset parallel alongside one another, and are composed of an electrically insulating material, a first secondary winding (4) whose turns are arranged on the first core (2), with the first secondary winding (4) having a number of parallel-connected layers **(4*a*, 4*b*, 4*c*, 4*d*) of turns, and each layer of turns being arranged without any offset above the next lower layer, so that each turn in any given layer is arranged above the corresponding turn of the layer located immediately underneath it of the first secondary winding (4), at least one further secondary winding (5) whose turns are arranged on at least one further core (3) which is in the form of a rod, with the second secondary winding (5) having a number of parallel-connected layers (5*a*, 5*b*, 5*c*, 5*d*) of turns, and each layer of turns being arranged without any offset above the next lower layer, so that each turn in any given layer is arranged above the corresponding turn of the layer located immediately underneath it of the at least one further secondary winding (5), with the secondary windings (4, 5) being electrically conductively connected to one another, and the total resistance of the secondary windings (4, 5)** being less than or equal to 2Ω.

2. A halogen metal-vapour high-pressure discharge lamp for use an a motor vehicle headlight having a discharge lamp cap (20), the discharge lamp cap (20) comprising a rod-core transformer (1) arranged in the discharge lamp cap (20) and used to produce a starting voltage for the discharge lamp, the rod-core transformer (1) comprising:

at least one primary winding (6, 7; 6'), at least two cores (2, 3) which are in the form of rods, are arranged with their longitudinal axes offset parallel alongside one another, and are composed of an electrically insulating material, a first secondary winding (4) whose turns are arranged on the first core (2), with the first secondary winding (4) having a number of parallel-connected layers **(4*a*; 4*b*, 4*c*, 4*d*) of turns, and each layer of turns being arranged without any offset above the next lower layer, so that each turn in any given layer is arranged above the corresponding turn of the layer located immediately underneath it of the first secondary winding (4), at least one further secondary winding (5) whose turns are arranged on at least one further core (3) which is in the form of a rod, with the second secondary winding (5) having a number of parallel-connected layers (5*a*, 5*b*, 5*c*, 5*d*) of turns, and each layer of turns being arranged without any offset above the next lower layer, so that each turn in any given layer is arranged above the corresponding turn of the layer located immediately underneath it of the at least one further secondary winding (5), with the secondary windings (4, 5) being electrically conductively connected to one another, and the total resistance of the secondary windings (4, 5)** being less than or equal to 2Ω.

3. A rod-core transformer for use as a starting transformer in a lamp cap (2) having the following features:

at least one primary winding (6, 7; 6'), at least two cores (2, 3) which are in the form of rods, are arranged with their longitudinal axes offset parallel alongside one another, and are composed of an electrically insulating material, a first secondary winding (4) whose turns are arranged on the first core (2), with the first secondary winding (4) having a number of parallel-connected layers **(4*a*, 4*b*, 4*c*, 4*d*) of turns, and each layer of turns being arranged without any offset above the next lower layer, so that each turn in any given layer is arranged above the corresponding turn of the layer located immediately underneath it of the first secondary winding (4), at least one further secondary winding (5) whose turns are arranged on at least one further core (3) which is in the form of a rod, with the second secondary winding (5) having a number of parallel-connected layers (5*a*, 5*b*, 5*c*, 5*d*) of turns, and each layer of turns being arranged without any offset above the next lower layer, so that each turn in any given layer is arranged above the corresponding turn of the layer located immediately underneath it of the at least one further secondary winding (5), with the secondary windings (4, 5) being electrically conductively connected to one another, and the total resistance of the secondary windings (4, 5)** being less than or equal to 2Ω.

4. The rod-core transformer according to claim 3, characterized in that the wire diameter of the secondary windings (4, 5) is greater than or equal to 0.1 mm.

5. The rod-core transformer according to claim 3, characterized in that the at least one primary winding (6, 7; 6') has one to three turns.

6. The rod-core transformer according to claim 3, characterized in that the secondary windings (4, 5) are connected in series.

7. The rod-core transformer according to claim 6, characterized in that the rod-core transformer (1) has two cores (2, 3) which are in the form of rods and have a respective secondary winding (4, 5) arranged on them, with each of the two secondary windings (4, 5) having 50 to 200 turns.

8. The rod-core transformer according to claim 3, characterized in that the cores (2, 3), which are in the form of rods, are in the form of nickel-zinc sintered ferrites.

9. The rod-core transformer according to claim 8, characterized in that the rod-core transformer (1) has two cores (2, 3) which are in the form of rods and have a respective secondary winding (4, 5) arranged on them, with each of the two secondary windings (4, 5) having 50 to 200 turns.

10. The rod-core transformer according to claim 3, characterized in that the rod-core transformer (1) has two cores (2, 3) which are in the form of rods and have a respective secondary winding (4, 5) arranged on them, with each of the two secondary windings (4, 5) having 50 to 200 turns.

11. The rod-core transformer according to claim 10, characterized in that the at least one primary winding (6, 7; 6') is arranged such that the magnetic flux in two cores (2, 3) which are in the form of rods and are arranged alongside one another in each case runs in opposite directions.

12. The rod-core transformer according to claim 3, characterized in that the at least one primary winding (6, 7; 6') is arranged such that the magnetic flux in two cores (2, 3) which are in the form of rods and are arranged alongside one another in each case runs in opposite directions.

13. The rod-core transformer according to claim 12, characterized in that ferrite platelets (12, 13) are arranged at the ends of the cores (2, 3) which are in the form of rods.

14. The rod-core transformer according to claim 12, characterized in that the distance between the ferrite platelets (12, 13) and the ends of the cores (2, 3) which are in the form of rods is adjustable.

15. The rod-core transformer according to claim 12, characterized in that a primary winding (6, 7) is arranged on each core (2, 3) which is in the form of a rod, with the primary windings (6, 7) being connected in parallel.

16. The rod-core transformer according to claim 12, characterized in that only one primary winding (6') is provided, whose turns are wound alternately in the opposite winding sense about a first (2) and a second (3) rod core.

17. The rod-core transformer according to claim 12, characterized in that the at least one primary winding (6, 7; 6') has one to three turns.

18. The rod-core transformer according to claim 3, characterized in that each core (2, 3) which is in the form of a rod is accommodated with the secondary winding (4, 5) that is arranged on it in a separate housing (8, 9), and the housings (8, 9) can be connected to one another by means of a plug connection (10).

19. The rod-core transformer according to claim 18, characterized in that the housings (8, 9) are filled with an electrically insulating encapsulation compound (16).

20. The rod-core transformer according to claim 19, characterized in that the encapsulation compound (16) contains ferrite powder.

* * * * *